United States Patent [19]

Pray

[11] 4,315,450

[45] Feb. 16, 1982

[54] METHOD OF AND APPARATUS FOR SCIVING BELTS

[75] Inventor: Winston C. Pray, Lombard, Ill.

[73] Assignee: Flexible Steel Lacing Company, Downers Grove, Ill.

[21] Appl. No.: 115,366

[22] Filed: Jan. 25, 1980

[51] Int. Cl.[3] ..... B26D 3/06; B26D 9/00

[52] U.S. Cl. ..... 83/862; 83/56; 83/614; 83/640; 83/745; 83/875

[58] Field of Search ..... 83/862–865, 83/875, 745, 743, 614, 487, 455, 49, 56, 640

[56] References Cited

U.S. PATENT DOCUMENTS

| | | | |
|---|---|---|---|
| 267,925 | 11/1882 | Pederson | 83/455 X |
| 840,928 | 1/1907 | Gamston | 83/614 |
| 1,733,929 | 10/1929 | Wright | 83/487 |
| 2,023,911 | 12/1935 | Boughton | 83/455 |
| 2,312,971 | 3/1943 | Norrid | 83/614 X |
| 2,434,292 | 1/1948 | Spencer | 83/875 X |
| 2,531,149 | 11/1950 | Melchor | 83/455 |
| 3,196,917 | 7/1965 | Frank | 83/865 |
| 3,515,019 | 6/1970 | Tyer, Jr. | 83/875 |
| 4,176,572 | 12/1979 | Pennington | 83/862 |
| 4,221,148 | 9/1980 | Lewis | 83/875 X |
| 4,224,854 | 9/1980 | Malacheski et al. | 83/745 |

*Primary Examiner*—Frank T. Yost

*Attorney, Agent, or Firm*—Fitch, Even, Tabin, Flannery & Welsh

[57] ABSTRACT

This invention teaches apparatus having track-like guide means adapted to be secured onto the face of a conveyor belt crosswise of the belt in the general area of a mechanical joint to be made in the belt. A carriage rides along the guide means, and supports first and second cutters used to cut a groove in the belt and to end cut the belt. Power means such as a winch is used to move the carriage along the guide means. The practiced method includes taking sequential passes of the cutter carriage to make these cuts, and taking like steps at the opposite ends of the belt span. The mechanical fastener can be received then in the matched recesses and secured to the underlying portions of the belt ends to join them together while having the fastener generally flush with the rubber overlay. The apparatus is entirely portable and particularly adapted for in-the-field repair and/or modification of existing conveyor belts.

10 Claims, 5 Drawing Figures

METHOD OF AND APPARATUS FOR SCIVING BELTS

BACKGROUND OF THE INVENTION

In conveyor belt systems, there generally is provided a continuous loop belt which is trained over opposite end rollers and intermediate support rollers. The belt is generally of a flat rectangular cross-section and has an extended length, and the ends of the belt are connected together in any of several ways to form the loop. For example, there are vulcanizing techniques which provide a virtually hidden joint having exterior surfaces smooth and flush with the belt surfaces; and there are mechanical fasteners which can be attached to butted opposite belt ends to hold them together. The belt itself generally includes a carcass having a woven or stranded inner casing and opposite upper and lower overlays or coatings of rubber or other flexible impervious material that protects the casing from abrasion, corrosion or the like. The formation of undercuts or grooves in the upper and lower surfaces of the belt to receive the mechanical fasteners has been a considerable problem. The depth of the undercut should be substantially uniform and the width should be relatively constant. The rubber, synthetic rubber or elastomeric material resists cutting with conventional cutters. Often the cutting must be done at the conveyor site where the belt has broken. In such instances, electrical power may not be readily available and it is not possible to cart large machines or apparatus to the belt ends to form the cuts. Thus, there is a need for a portable apparatus which will form the desired undercuts in such belts and is often in very adverse environments with only manual force available to make the undercut.

SUMMARY OF THE INVENTION

This invention relates to apparatus for and a method for sciving or removing a portion of the conveyor belt surface to form an undercut which can receive belt fasteners.

The apparatus includes track-like guide means adapted to be secured onto the face of the belt crosswise of the belt in the general area of the expected joint, a carriage that rides along the guide means, first and second cutters carried on the carriage and used to cut the belt, and power means to move the carriage along the guide means. The practiced method includes using the first cutter to initially skive or cut part of the rubber overlay away from the belt carcass to provide a groove across the belt, and then using the second cutter to cut the belt completely through within the groove to provide a stepped but smooth cross edge. Thus, like-fabricated opposite cross edges of the belt can be butted against one another, and a mechanical fastener can be received in the matched recesses and secured to the underlying portions of the belt ends to join them together. The fastener is thus generally flush with the flexible rubber covering. The apparatus is entirely portable and particularly adapted for in-the-field repair and/or modification of existing conveyor belts.

The preferred first cutter is U-shaped having a medial cutting blade adapted to be lined up generally parallel to the belt surface and two side cutting blades angled away from the medial blade and secured to a block carried on the carriage. Suitable adjustment mountings are provided between the carriage and block to allow proper depth adjustment of the medial cutting blade relative to the adjacent belt surface to be cut. Ideally further the medial cutting blade is slanted slightly toward the belt to dig into the belt, and the forward cutting edge on the medial cutting blade is V-shaped from a forward sharp midpoint slanting rearwardly away to the side edges. The second cutter is planar and extended normal to the belt, and suitable block support and adjustment mountings are provided relative to the carriage to allow for depth adjustment to cut completely through the belt independently of its thickness and to allow for special adjustment of the cut from the interior edge of the groove already formed. This allows the stepped recess formed on each belt end to be sized exactly to receive the intended mechanical fastener.

Preferably the carriage is moved in a uniform manner with a smooth and continuing force provided for example, by means of a cable connection to a winch supported laterally of the belt and which can be manipulated either manually or with an electric motor or equivalent.

DETAILED DESCRIPTION OF THE INVENTION

Figure 1:
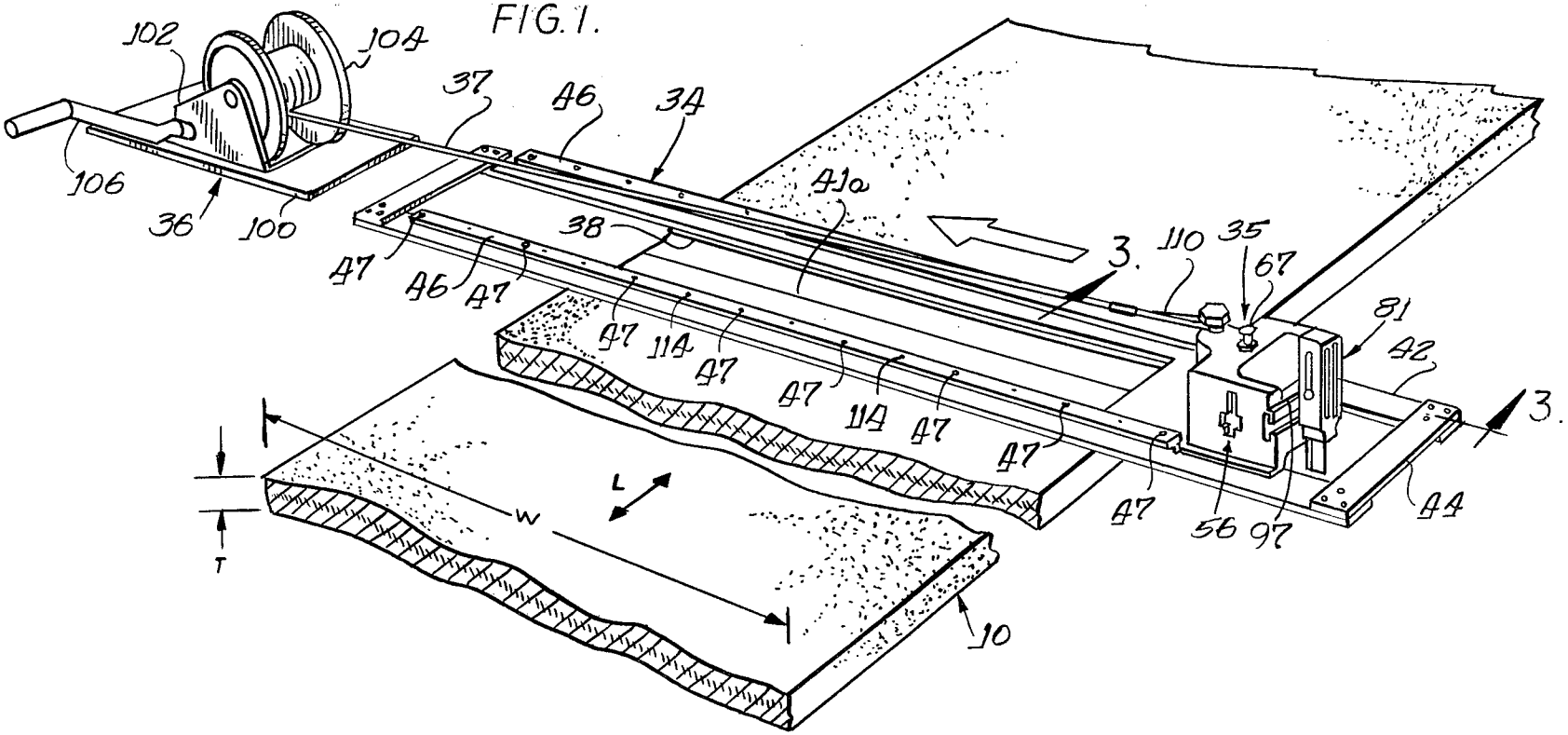
FIG. 1 is a perspective view of a typical conveyor belt, and showing also in operative association therewith, apparatus forming the basis of this invention for grooving and end cutting the belt in such a manner so as to allow opposite like end portions of the belt to be secured together with a mechanical fastener.
Figure 5:
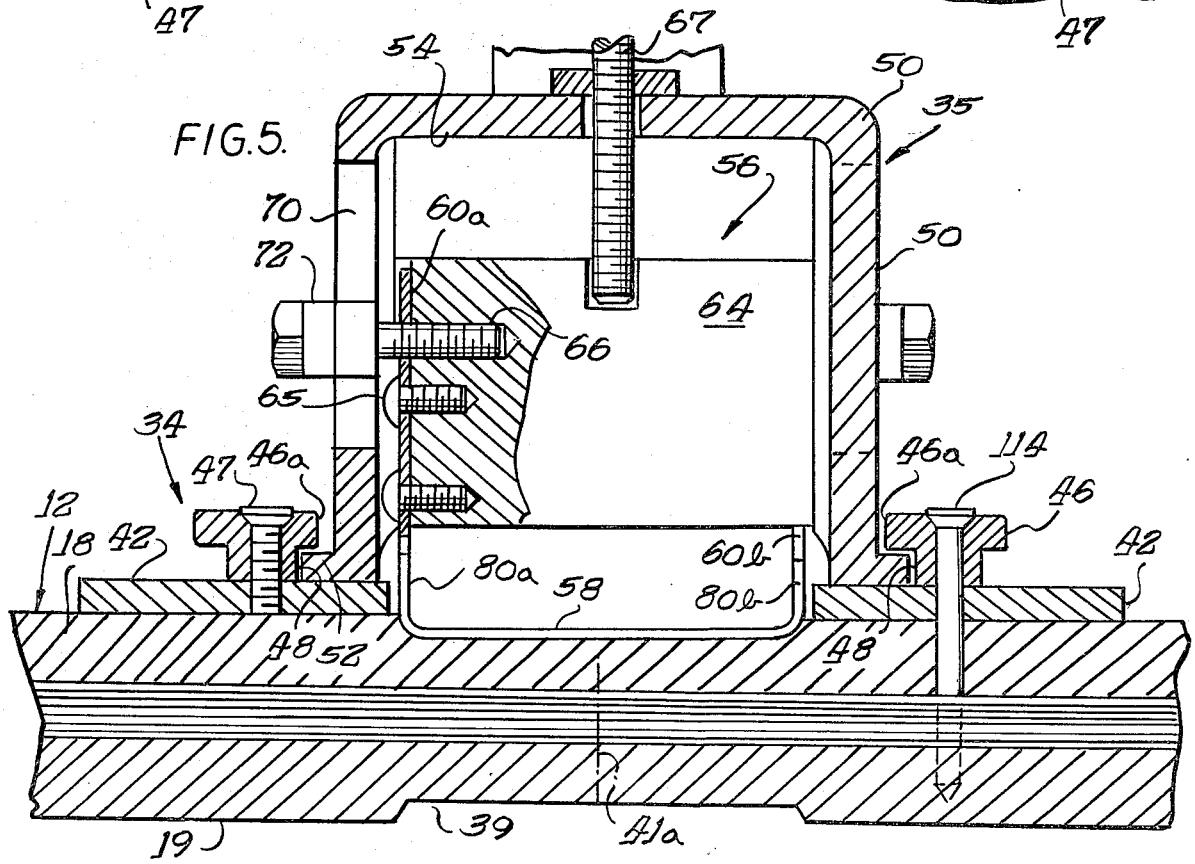

FIG. 1 illustrates a conveyor belt 10 of width W, thickness T, and length L. The belt 10 has a cross section similar to that illustrated in FIGS. 2, 3 and 5, for example, consisting of a carcass 12 having woven or braided casing 16 extending the length of the belt and protective upper and lower overlays or coatings 18, 19 of rubbers which completely cover the casing 16 to protect the same and further to provide smooth exterior belt faces. In belts to which this particular invention applies, the belt thickness T across the outer faces of the overlays 18 and 19 might be up to several inches, the belt width W might be up to several feet while the belt length L might exceed several hundred feet. The thickness of each overlay 18, 19 would range typically between $\frac{1}{8}''$ and $\frac{1}{2}''$.

Figure 2:
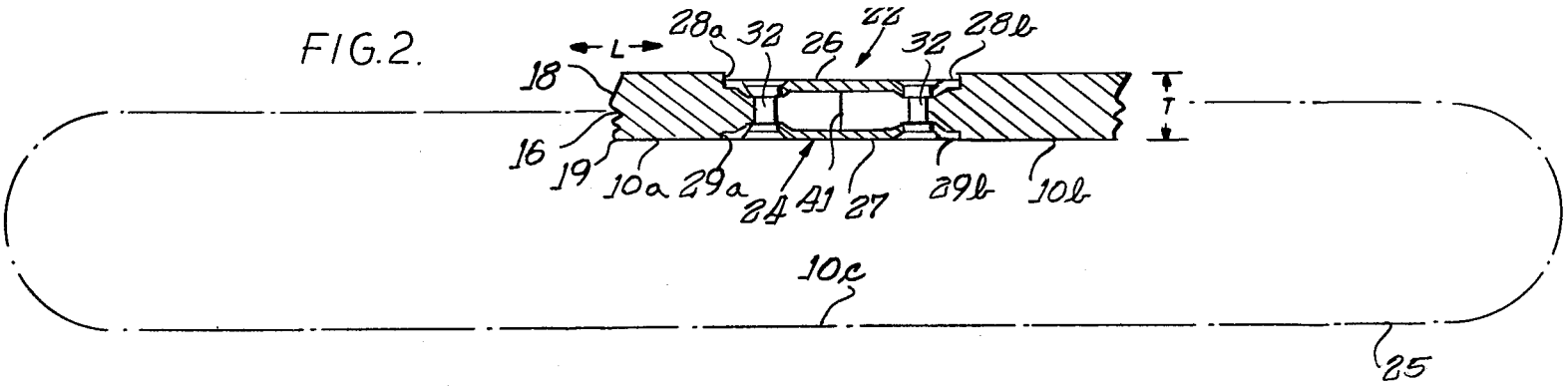
FIG. 2 is an enlarged crosswise sectional view of a mechanical fastener connection joint used to hold opposite end portions of the belt of FIG. 1 butted together, that is after the apparatus of FIG. 1 has grooved and cut the belt and the mechanical fastener has been secured in place.
Figure 3:
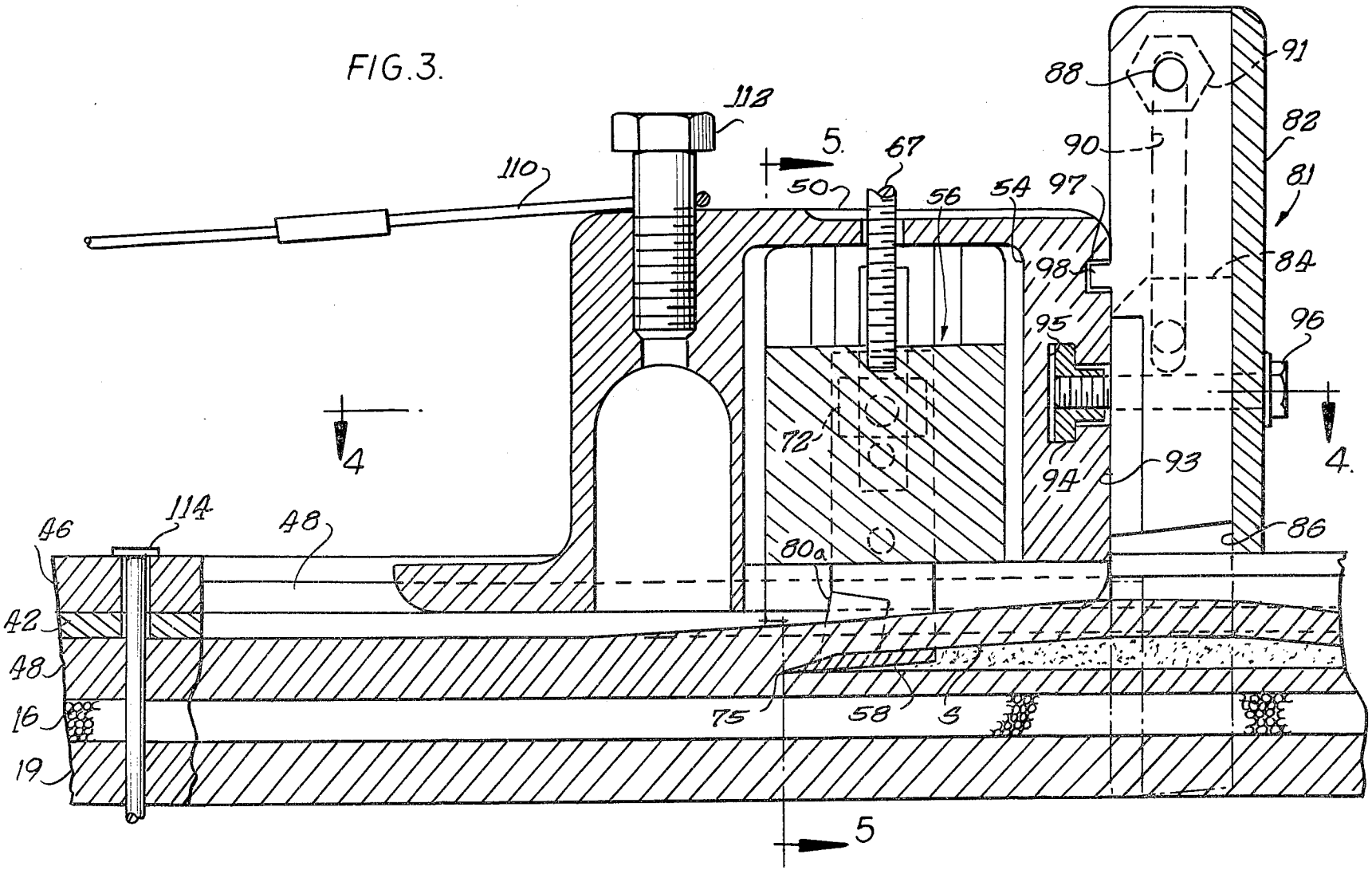
FIG. 3 is an elevational sectional view as seen generally from line 3–3 in FIG. 1, except showing the apparatus in cutting association with the belt.

FIG. 2 illustrates in cross section a mechanical fastener joint or connection 22 having a mechanical fastener 24 secured to opposite belt ends 10*a* and 10*b*. In a typical connected arrangement, the belt ends 10*a* and 10*b* would be common to one another across interconnecting portion 10*c* of the belt, and the belt as secured would form a continuous loop 25 which could be trained over end rollers (not shown) and intermediate support guides or rollers (not shown).

The particular fastener 24 illustrated includes upper and lower elongated plates 26 and 27 which extend across the width W of the belt 10 and fit within matched recesses 28*a*, 28*b*, 29*a* and 29*b* formed within the upper and lower overlays 18 and 19, respectively to maintain the exterior faces generally uniform or flush with the overlay. Bolts, rivots or like fasteners 32 fit through aligned openings in the belt and are secured to the upper and lower plates 26 and 27 to hold the plates relative to one another and to hold the opposite belt ends 10*a* and 10*b* adjacent and generally butted against one another.

The apparatus to which this invention pertains consists of a track-like guide system 34 which extends crosswise to the belt, a carriage 35 guided by the guide system 34, a power actuator shown in the form of a winch 36, and a cable 37 interconnecting the carriage 35 and winch 36. The carriage 35 supports cutting means thereon which are suited to cut transverse upper and lower groove 38, 39 (FIGS. 1 and 5) from the respective belt overlays 18, 19 and to cut the belt completely through somewhat along the line 41*a* to define a belt edge 41.

The track-like guide system 34 includes a pair of base plates 42 connected at their opposite ends by cross members 44, and a T-bar 46 is secured by spaced bolts 47 in overlying relation to each base plate 42. Flanges 46*a* (FIG. 5) of the respective T-bars thus spaced from the base plates define therewith facing channels 48. The carriage 35 includes a body 50 having opposite lower flanges 52 of such shape and size to fit within the channels 48 so as to allow sliding movement of the carriage only along the base plates 42 and without canting or twisting. The base plates 42 extend beyond the opposite edges of the belt, and likewise the T-bars 46 extend beyond the belt edges, but not to the cross members 44 so that the carriage 35 can be easily fitted into the channels 48 between the cross members 44 and the ends of the T-bars 46 only at the starting end.

The body 50 is generally hollow or cup shaped at its mid section as illustrated by cavity 54, and a groove cutter 56 fits within this cavity. In a preferred embodiment, the cutter 56 is U-shaped having a central horizontal blade portion 58 and two spaced vertical blade portions 60*a* and 60*b* extending upwardly at and from opposite ends of the central horizontal blade portion 58. The vertical blade portions 60*a* and 60*b* fit in recesses 62 in opposite faces of a blade holding block 64 and are secured to the block by spaced bolts 65 being threaded into the block through openings in the blades. The block 64 is supported in turn by bolts 66 threaded into taps in the block and protruding through slots 70 in the side walls of the carriage body 50 and through T-shaped slides 72 adjustably carried within the slots 70. Upon tightening the bolts 66 against the slides 72, the block can be held with the blade 58 at any adjusted depth below the exterior face of the belt overlay so as to cut away the overlay and form the groove 38 or 39. To assist in holding the block while the bolts 66 are being tightened, a holding screw 67 may be grabbed at its head and because its lower end is threaded into the top of the holding block 64, the block may be held with one hand while the operator tightens the bolts 66. Also, a lock nut 68 may be turned down to abut the top of the blade carriage body 50 to return the cutter blade and the holding block back to the same depth for future cuts.

Figure 4:
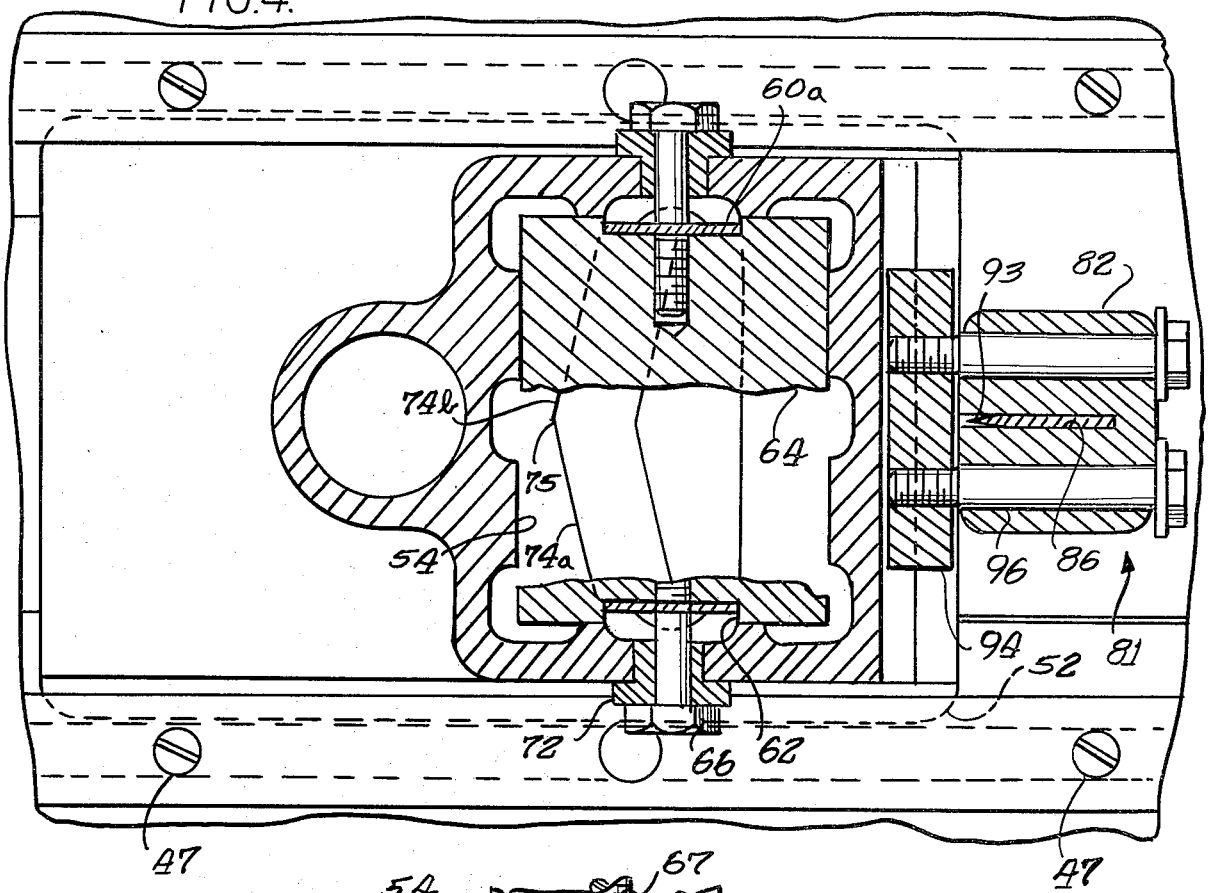
FIGS. 4 and 5 are sectional views, respectively, as seen generally from lines 4—4 and 5—5 in FIG. 3.

In a preferred embodiment, the cutting blade 58 has a V-shaped lead edge (See FIG. 4) including two diverging edges 74*a* and 74*b* tapered rearwardly from point 75 toward the side blade portions. Further, lead point 75 is slightly lower than the two diverging edges (See FIG. 3) as it is angled downwardly toward the belt at an angle of 2°, in this instance. This downward slant tends to cut the overlay with a slight digging action that holds the carriage flanges snugly against the guiding tracks 42. The side blade portions 60*a* and 60*b* also have forward cutting edges 80*a* and 80*b* which join at corners with the cutting edges 74*a* and 74*b*. The corners are formed with a radius to provide a radius at the juncture of the vertical and horizontal cuts in the belt to prevent a sharp, right angle corner in the belt which can be the source of crack propagation. This cutter 56 thus removes with a single cutting stroke a thin slice from the belt overlay that forms a crosswise or transverse groove 38 or 39.

The blade carriage 35 also has cutter 81 for completely cutting the belt in two. This is illustrated by block 82 and an elongated straight blade 84 received in slot 86 of the block 82. Bolt 88 is fitted through an opening in the blade 84 and fits also through elongated slots 90 in the block to allow by means of tightening nut 91 the blade to be adjusted and secured relative to the cutting block 82. The lower end of the blade 84 has a sharp V-shaped edge 93 suited for cutting through the belt upon forward movement of the carriage 35 crosswise of the belt. The block 82 in turn is secured relative to the body 50 by means of a T-shaped slide 94 fitted within a transverse recess 95 of generally like shape to allow for transverse adjustment of the block 82 relative to the carriage body 50 and by means of bolts 96 extended through openings in the block and threaded into the slide 94. To maintain the blade perpendicular to the belt and to the base, it is preferred to provide an interfitting slide projection and groove arrangement between the block 82 and the cariage body 50. Herein, a horizontal groove 97 (FIG. 3) is formed in the rear wall of the carriage 35 and a complementary sized slide projection 98 on the block 82 fits in and slides within the groove. The block 82 can be adjusted laterally of the carriage body 50 with sufficient degrees of adjustment to locate the blade precisely relative to the inner finished edge of the groove 38 or 39 and thus determine the width of the undercut.

The winch 38 can be of conventional design, including for example a base plate 100 and upstanding side frames 102 which rotatably support therebetween drum 104 upon which cable 37 can be wound. A handle 106 is connected to the drum to provide powered cable movement toward the winch 36 upon rotation of the handle 106. The free end of the cable 37 in turn is connected to the blade carriage 35 by a loop 110 fitted over upstanding bolt 112 threaded into a tap formed on the body 50.

The disclosed apparatus would most effectively be used in-the-field to repair a damaged belt or to modify a belt for example to a different size loop 25. The belt is initially laid flat on an appropriate surface and the track guide system 34 is fixed against one side of the belt in a perpendicular or crosswise orientation by driving nails 114 through spaced openings provided in the base plate 42, such as alternately between the bolts 47. The cutter 56 can be adjusted relative to the carriage with the blade 58 located at the proper depth below the upper surface of the belt when the carriage is located to the starting end of the track guide system 34 as illustrated in FIG. 1. Appropriate means are then used to locate the winch 36 or other suitable power device relative to the opposite end of the track guide means 34 and to connect the winch cable 37 to the carriage 35. With the cutter 56 thereby adjusted, uniform operation of the winch 36 moves the blade carriage 35 uniformly crosswise of the belt 10 causing the blade cutting edges 74*a*, 74*b*, 80*a* and 80*b* to cut out from the overlay a generally uniform rectangular like strip S of the overlay and thereby leave in the belt the groove 38. With this cut thus made, the belt would be turned over to perform an identical grooving operation in the opposite overlay to form the groove 39. With both grooves 38, 39 thus formed, the operator would then secure in place the cutter 81 and in turn adjust the blade 84 to the proper depth and again move the cutter carriage crosswise of the belt to effect complete cutting or separation of the belt into two pieces. This would also define a smooth but stepped transverse edge across one end 10*a* of the belt. The same procedure would be followed on the opposite end 10*b* of the belt 10 to define a finished smooth but stepped transverse edge. The mechanical fastener 24 would then be applied between the opposite belt ends 10*a* and 10*b* for securing them relative to one another.

The disclosed apparatus and method are particularly useful for in-the-field repair and/or modification of a conveyor belt at a low cost and with a minimal downtime of the conveyor. The carriage may be used to form undercuts only and in that case, the cutoff blade 84 would not be used or provided. On the other hand, only the cutoff blade could be used without the U-shaped blade for making the undercut.

While the winch is disclosed as being manually powered, an electric or internal combustion engine could be used to turn the winch and pull the cable. It has been found that pulling of the cutter blade with a smooth and uniform pulling force works better than trying to push the blade or to apply variable, intermittent forces. A constant uniform pull seems to avoid digging in of the blade as may otherwise occur. Herein, the belt and the support means are nailed to an underlying wooden plank (not shown) by the nails 114. The winch may also be fastened to the wooden plank, if so desired.

What is claimed is:

1. A method of forming a groove in a belt end and in cutting off the portion of the belt to form a butt end comprising the steps of: securing a support means onto one face of the belt means crosswise of the belt means and in the general area it is desired to form a butt end, adjusting first cutter means on a carriage relative to the support means so that the first cutter means lines up below the one belt means face, connecting a power means to said carriage, advancing the first cutter means across the belt means and the support means by said power means so that the first cutter means cuts a slice from the one face to leave a groove crosswise of the belt means, adjusting a belt cutoff cutter means on said carriage so that the second cutter means lines up transverse to the belt means, advancing the carriage and the second cutter means along the means support by said power means so that the second cutter means cuts the belt means in two in the area of the groove to define a butt end for the first end portion of the belt means.

2. A method in accordance with claim 1 including the step of advancing the carriage by turning a winch of a power means to pull a cable extending to the carriage.

3. An apparatus for cutting a conveyor belt comprising:

a support adapted be laid across the belt, means for facilitating the securing of the support to the belt, a cutter carriage moveable along a straight line path of travel on said support means, a depending cutter on said carriage for cutting a groove in the belt, said cutter being U-shaped having a generally horizontal center blade portion, and having two upstanding side blade portions joined to said central blade portion, said center blade portion having a V-shaped edge with a forwardly facing pointed edge, guide means on said carriage and support for guiding the carriage along the straight line path of travel; and a power means connected to said carriage for moving said carriage forwardly across the belt with said cutter cutting said belt along its straight path of travel.

4. An apparatus in accordance with claim 3 including an adjustment means for adjustably mounting said depending cutter on said carriage for shifting vertically the position of said center blade portion relative to said support to change the depth of the groove being cut in the belt.

5. An apparatus in accordance with claim 4 in which said carriage includes a block shaped member, said adjustment means including a vertical slide engagement between said cutter and said block and including means to lock the position of said cutter in said block.

6. An apparatus in accordance with claim 5 in which two diverging edges extend rearwardly on the V-shaped cutter edge from said forwardly facing pointed edge thereof, said forwardly facing pointed edge being slightly lower than the two diverging edges to provide a digging action to hold the guide means against one another.

7. An apparatus in accordance with claim 3 in which said carriage includes a block shaped member having a vertical opening therein within which said cutter may be shifted vertically to adjust the depth of cut of the groove, a second cutter for cutting the belt in two being secured to the rearward portion of said carriage block.

8. An apparatus for sciving a generally rectangular strip transversely across the width of a conveyor belt having an upper face along the edge of a belt comprising:

a support adapted be laid across the belt, means for facilitating the securing of the support to the belt, a cutter carriage moveable along a straight line path of travel on said support means, a depending cutter on said carriage for cutting a groove in the belt, said cutter having an upstanding side blade portion having a forward cutting edge to cut normal to said face, said cutter having a bottom blade portion for making a cut parallel to said face for removing an overlying strip from said belt with the strip sliding across the top of the blade portion, said cutter having a radiussed corner blade portion joining said upstanding side blade portion and one end of said bottom blade portion for cutting a radius corner between the side cut and bottom cut in said belt, means connecting the other end of said bottom blade portion to said carriage means to hold said other blade end during the cutting of said strip, guide means on said carriage and support for guiding the carriage along the straight line path of travel; and a power means operated by a manual operator means connected to said carriage for moving said carriage forwardly across the belt with said cutter cutting said belt along its straight path of travel.

9. An apparatus in accordance with claim 8 in which said means connecting the other end of said bottom blade portion to said carriage means comprises a second upstanding blade portion having a forward cutting edge paralled to said first mentioned upstanding side blade portion to cut the belt normal to the belt face.

10. Apparatus for cutting a conveyor belt, comprising guide means adapted to be secured onto one face of the belt crosswise of the belt, carriage means supported and guided for straight line travel along the guide means, a first cutter supported on the carriage means to cut a slice from the one face of the belt to leave a groove crosswise of the belt, a second cutter on said carriage to cut the belt in two within the slice cut by said first cutter, power means connected to the carriage means for moving said cutter along the guide means, said first cutter being generally U-shaped and having an intermediate blade and spaced end blades angled from the intermediate blade, a first adjustment means for positioning said first cutter on said carriage means so that the intermediate blade lines up below the one belt face generally by the thickness of the slice intended to be cut from the belt face, said second cutter being generally flat and having a lead cutting edge, and a second adjustment means for said second cutter including means for adjusting the location within the groove where the cutting edge of the second cutter engages and thus cuts the belt.

* * * * *